US006395462B2

(12) United States Patent
Goswami et al.

(10) Patent No.: US 6,395,462 B2
(45) Date of Patent: May 28, 2002

(54) PHOTOGRAPHIC PROCESSING COMPOSITIONS CONTAINING STAIN REDUCING AGENT

(76) Inventors: Ramanuj Goswami; Mary E. Craver; Harry J. Price, all of Eastman Kodak Company 343 State St., Rochester, NY (US) 14650

( * ) Notice: Subject to any disclaimer, the term of this patent is extended or adjusted under 35 U.S.C. 154(b) by 0 days.

(21) Appl. No.: 09/775,280

(22) Filed: Feb. 1, 2001

Related U.S. Application Data

(62) Division of application No. 09/570,970, filed on May 15, 2000, which is a division of application No. 09/464,551, filed on Dec. 16, 1999, now Pat. No. 6,153,365.

(51) Int. Cl.[7] ..... G03C 5/39; G03C 7/30
(52) U.S. Cl. ..... 430/463
(58) Field of Search ..... 430/463

(56) References Cited

U.S. PATENT DOCUMENTS

| | | | | |
|---|---|---|---|---|
| 4,232,112 A | | 11/1980 | Kuse | 430/393 |
| 4,587,195 A | | 5/1986 | Ishikawa et al. | 430/139 |
| 4,837,310 A | | 6/1989 | Morimitsu et al. | 534/638 |
| 4,841,032 A | | 6/1989 | Morimitsu et al. | 534/642 |
| 4,895,786 A | | 1/1990 | Kurematsu et al. | 430/139 |
| 4,956,268 A | * | 9/1990 | Nakazyo et al. | 430/393 |
| 5,043,253 A | | 8/1991 | Ishikawa | 430/393 |
| 5,147,765 A | | 9/1992 | Goto et al. | 430/376 |
| 5,221,597 A | | 6/1993 | Fujita et al. | 430/393 |
| 5,272,044 A | | 12/1993 | Nishigaki et al. | 430/393 |
| 5,955,248 A | | 9/1999 | Craver et al. | 430/458 |

FOREIGN PATENT DOCUMENTS

| | | |
|---|---|---|
| EP | 0 341 637 A1 | 11/1989 |
| EP | 0 439 142 A1 | 7/1991 |
| EP | 0 565 023 A1 | 10/1993 |
| JP | 4249243 | 9/1992 |
| JP | 05056389 | 8/1993 |
| JP | 08054720 | 2/1996 |
| JP | 10090844 | 4/1998 |
| JP | 10 104809 | 4/1998 |
| WO | WO 97/10887 | 3/1997 |

OTHER PUBLICATIONS

JP Abstract 10104809.
JP Abstract 1062642.
JP Abstract 1158443.
Jp Abstract 58–222156.
DE Abstract 2203302.
*Research Disclosure*, Item 37336, May 1995.
*Research Disclosure*, Item 20733, Jul. 1981.

* cited by examiner

*Primary Examiner*—Hoa Van Le
(74) *Attorney, Agent, or Firm*—J. Lanny Tucker

(57) ABSTRACT

Specific aromatic compounds having an extended planar π system are useful as spectral sensitizing dye stain reducing agents in photographic processing compositions and methods for providing color or black-and-white images in various photographic silver halide materials. These compounds are devoid of diaminostilbene fragments or fused triazole nuclei. They are particularly useful in fixing and bleaching compositions in the processing of color photographic silver halide materials, but can also be used in various other processing compositions.

16 Claims, No Drawings

PHOTOGRAPHIC PROCESSING COMPOSITIONS CONTAINING STAIN REDUCING AGENT

CROSS-REFERENCE TO RELATED APPLICATION

This is a Divisional of application Ser. No. 09/570,970 filed May 15, 2000, which is a Divisional of application Ser. No. 09/464,551 filed Dec. 16, 1999, now U.S. Pat. No. 6,153,365 both now allowed.

FIELD OF THE INVENTION

This invention relates to novel photographic processing compositions. In particular, it relates to photographic processing compositions that reduce stain resulting from residual sensitizing dyes. This invention is useful in the photographic industry.

BACKGROUND OF THE INVENTION

The conventional image-forming process of silver halide photography includes imagewise exposure of a photographic silver halide recording material to actinic radiation (such as visible light), and the eventual manifestation of a useable image by wet photochemical processing of that exposed material. A fundamental step of photochemical processing is the treatment of the material with one or more developing agents to reduce silver halide to silver metal. With black-and-white photographic materials, the metallic silver usually comprises the image. With color photographic materials, the useful image consists of one or more organic dye images produced from an oxidized color developing agent formed wherever silver halide is reduced to metallic silver.

To obtain useful color images, it is usually necessary to remove all of the silver from the photographic element after color development. This is sometimes known as "desilvering". Removal of silver is generally accomplished by oxidizing the metallic silver, and then dissolving it and undeveloped silver halide with a "solvent" or fixing agent in what is known as a fixing step. Oxidation is achieved using an oxidizing agent, commonly known as a bleaching agent. For some processing methods, these two functions can be performed in the same processing step in what is known as bleach-fixing.

Common bleaching agents include ferric salts and ferric complexes of various polycarboxylic or polyaminopolycarboxylic chelating ligands. Common fixing agents include thiosulfate salts (both ammonium and sodium thiosulfate salts) and thiocyanates.

Color photographic silver halide materials often contain various spectral sensitizing dyes that extend the inherent photosensitivity of the photosensitive silver halide emulsions to electromagnetic radiation. One important class of such spectral sensitizing dyes includes carbocyanine sensitizing dyes that are commonly included in silver halide emulsion layers in photographic silver halide films. For example they are often present in color reversal photographic silver halide films (films normally used to provide color positive images).

Many photographic silver halide elements contain residual spectral sensitizing dyes after photoprocessing. In some cases, the level of retained spectral sensitizing dyes is inconsequential and thus, unobservable. In other instances, however, the high level of retained spectral sensitizing dye results in undesirably high dye stain (or unwanted color) in the elements. This dye stain problem is aggravated when the silver halide elements are designed for shorter wet processing times, or when certain silver halide emulsions are used that require higher concentrations of sensitizing dyes.

A number of solutions have been proposed for this problem, including the inclusion of common water-soluble stilbene optical brighteners, such as diaminostilbene compounds, in various photographic processing compositions. For example, such compounds are known to be used in color developer compositions [as described for example, in *Research Disclosure,* 20733, page 268, July, 1981 and U.S. Pat. No. 4,587,195 (Ishikawa et al) and as commonly used in the commercial Process RA-4 color developing compositions available from a number of manufacturers], bleach-fixing compositions [as described for example, in JP 1-062642 (published Mar. 9, 1989), JP 1-158443 (published Jun. 21, 1989), and U.S. Pat. No. 5,043,253 (Ishikawa)], or dye stabilizing compositions used at the end of the color photographic photoprocessing [as described for example in U.S. Pat. No. 4,895,786 (Kurematsu et al)].

In addition, it has been proposed to include stilbene optical brighteners in sodium ion containing fixing solutions to solve the problem with retained spectral sensitizing dye, as described in *Research Disclosure* 37336, page 340, May 1995. Such fixing solutions have sodium ions as the predominant cation because of the environmental concerns presented by ammonium ions. However, the presence of sodium ions slows down the fixing process, and this reduction in photoprocessing speed may be unacceptable in some instances. A reduction or elimination of the sodium ions for that reason may be required when certain films (such as color reversal films) are being processed.

It has also been observed that when the noted stilbene compounds were added to conventional ammonium ion containing fixing solutions at appropriate concentrations needed to reduce dye stain, the stilbene compounds were not stable over a desired shelf life. The stilbene compounds stayed in solution for a brief time after mixing, but upon storage for only a few hours, the solutions exhibited considerable precipitation. In fact, the *Research Disclosure* publication 37336 (noted above) also suggests that stilbene compounds are incompatible in fixing solutions containing high ammonium ion concentration. Thus, it would appear that there is no incentive for a skilled worker in the photographic industry to use common triazinylstilbene optical brighteners in fixing solutions containing high ammonium ion content. One such triazinylstilbene compound is known commercially as PHORWITE REU (also sometimes known as BLANKOPHOR REU, available from Bayer), and another commercially known stilbene is TINOPAL (available from Ciba).

In addition, many optical brighteners known in the art have limited solubility in aqueous processing compositions, especially concentrated compositions. Thus, their usefulness is limited. In addition, the inherent strong fluorescence of these compounds becomes a liability and limits their usefulness in instances where they cannot be removed completely from the system.

There remains a need in the photographic industry for a way to decrease the stains resulting from retained spectral sensitizing dye during photoprocessing without the problems noted above. In particular, there is a need for sensitizing dye stain reducing compounds that are more stable in various processings compositions.

SUMMARY OF THE INVENTION

The problems with known processing methods and compositions are overcome with a composition comprising at least $5\times10^{-5}$ mol/l of a spectral sensitizing dye stain reducing agent that is a colorless or slightly yellow compound having an extended planar π system, that is devoid of a diaminostilbene fragment or fused triazole nuclei, and has a solubility of at least $5\times10^{-5}$ mol/l in water at room temperature.

This invention also provides a spectral sensitizing dye stain reducing photoprocessing composition as described above but with one or more additional components that are photochemicals useful in one or more steps of photographic processing methods.

The advantages of this invention are several. The compounds used as spectral sensitizing dye stain reducing agents are highly soluble in aqueous photographic processing compositions. Their inherent fluorescence is relatively less than known compounds so that fluorescence is not a problem when the compound cannot be removed from the photographic material or processing composition. The aromatic compounds useful in this invention can be incorporated within a variety of photographic processing compositions, not just one particular composition. They can also be used in a separate aqueous solution that has essentially no photochemicals. Thus, the present invention provides considerable flexibility in how they are effectively used both in the type of photographic composition used and the photographic material processed.

DETAILED DESCRIPTION OF THE INVENTION

The photographic spectral sensitizing dye stain reducing agents useful in this invention are colorless of slightly yellow in color. They are compounds having an extended planar π system. By this is meant they are compounds that have planar delocalized electron densities extending over more than ten non-hydrogen atoms. There can be a mixture of such compounds in the compositions of this invention, in any suitable proportions.

In addition, the compounds useful in this invention lack a diaminostilbene fragment or moiety that is common in some optical brightener compounds of the art that are known to reduce stain occurring from residual photographic spectral sensitizing dye. The compounds are also devoid of a fused triazole nucleus (unlike the compounds in U.S. Pat. No. 5,272,044 of Nishigaki et al).

More particularly, the photographic spectral sensitizing dye stain reducing agents are 2,6-diarylaminotriazines (including but not limited to 2,6-dinaphthylaminotriazines). It is especially desirable that these compounds have at least two solubilizing groups attached to one or both aryl groups in the molecule. Useful solubilizing groups include, but are not limited to, sulfo, carboxy, hydroxy, carbonamido, sulfonamido and other groups readily apparent to one skilled in the art. The sulfo and carboxy groups are preferred, and the sulfo groups are most preferred. The maximum number of solubilizing groups in a given molecule is limited only by the available number of substituent positions, but for practical purposes, there may be up to ten of the same or different solubilizing groups in the molecules.

In preferred embodiments of this invention, the processing compositions of this invention comprise one or more photographic spectral sensitizing dye stain reducing agents represented by Structure I as follows:

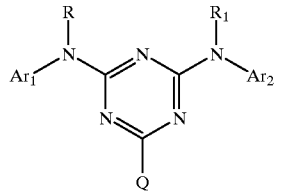

wherein $Ar_1$ and $Ar_2$ are independently carbocyclic or heterocyclic aromatic groups comprising at least 2 solubilizing groups on one or both aromatic groups. Useful aromatic groups generally have from 6 to 14 carbon atoms in the ring (for carbocyclic groups) or from 5 to 14 carbon, oxygen, sulfur and nitrogen atoms in the ring (for heterocyclic groups). Representative groups include, but are not limited to, substituted or unsubstituted phenyl groups, substituted or unsubstituted naphthyl groups, substituted or unsubstituted anthryl groups, substituted or unsubstituted pyridyl groups, substituted or unsubstituted benzimidazole groups, and substituted or unsubstituted benzothiazole groups. The substituted or unsubstituted carbocyclic aromatic groups are preferred and the substituted or unsubstituted naphthyl groups are more preferred. Besides the solubilizing groups described herein, either or both aromatic groups can be substituted with (that is, by replacement of a hydrogen atom) additional substituents that do not adversely affect their beneficial effects in the processing compositions.

Also in Structure I above, Q is hydrogen, hydroxy, thiol, sulfo, carboxy, a —$NR_2R_3$ group, a —$OR_2$ group, or a halo group (such as fluoro, chloro, bromo or iodo). Preferably, Q is hydrogen, hydroxy, thiol, sulfo or a halo group (such as chloro or bromo), and more preferably, it is sulfo. As used throughout this application, "sulfo" and "carboxy" refer to the respective free acid moieties as well as their equivalent salts (such as ammonium ion and alkali metal salts).

R and $R_1$ are independently hydrogen, substituted or unsubstituted alkyl groups having 1 to 3 carbon atoms (such as methyl, ethyl, n-propyl or isopropyl) or substituted or unsubstituted hydroxyalkyl groups having 1 to 3 carbon atoms (such as methoxy, 2-ethoxy, isopropoxy, methoxymethoxy). Preferably, R and $R_1$ are independently hydrogen, methyl or hydroxymethyl, and preferably, each is hydrogen.

$R_2$ and $R_3$ are independently hydrogen, substituted or unsubstituted alkyl groups having 1 to 6 carbon atoms (such as methyl, hydroxymethyl, 2-hydroxyethyl, carboxymethyl, ethyl, isopropyl, n-propyl, 5-carboxy-n-pentyl and hexyl), or substituted or unsubstituted phenyl groups (such as xylyl, tolyl, 4-hydroxyphenyl, 4-carboxyphenyl and 3,5-disulfophenyl).

As indicated in the preceding paragraphs, any of Q, R, $R_1$, $R_2$ and $R_3$ can be substituted with one or more solubilizing groups that are defined above.
Representative compounds useful in the practice of this invention include, but are not limited to, the following compounds:
Compound 1
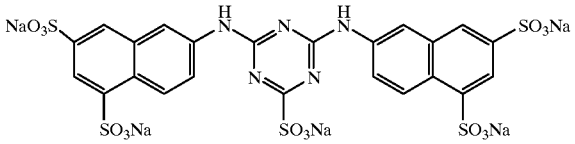
Compound 2
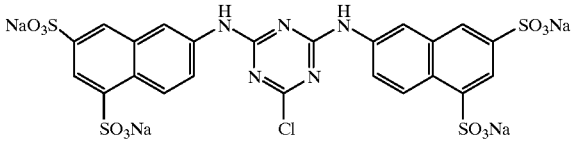
Compound 3
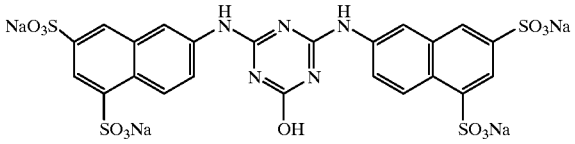
Compound 4
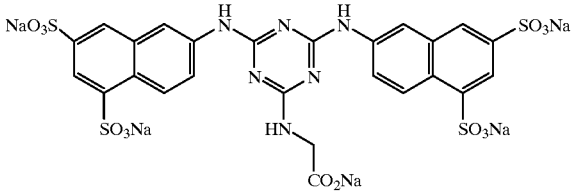
-continued
Compound 5
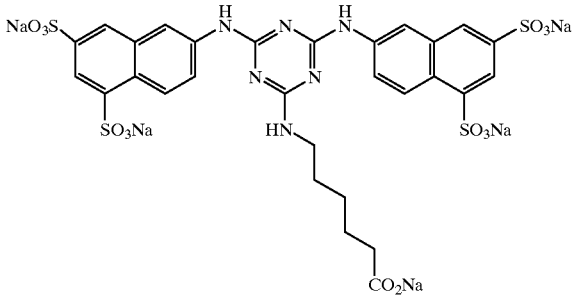
Compound 6
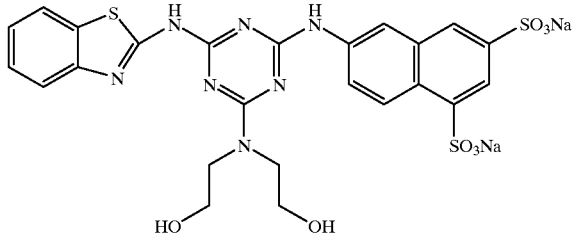
Compound 7
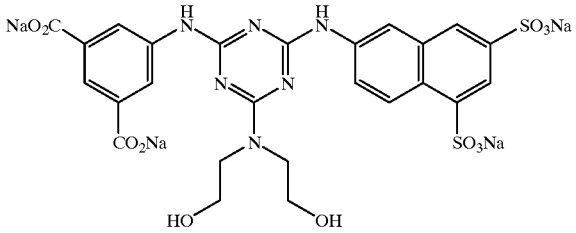
Compound 8
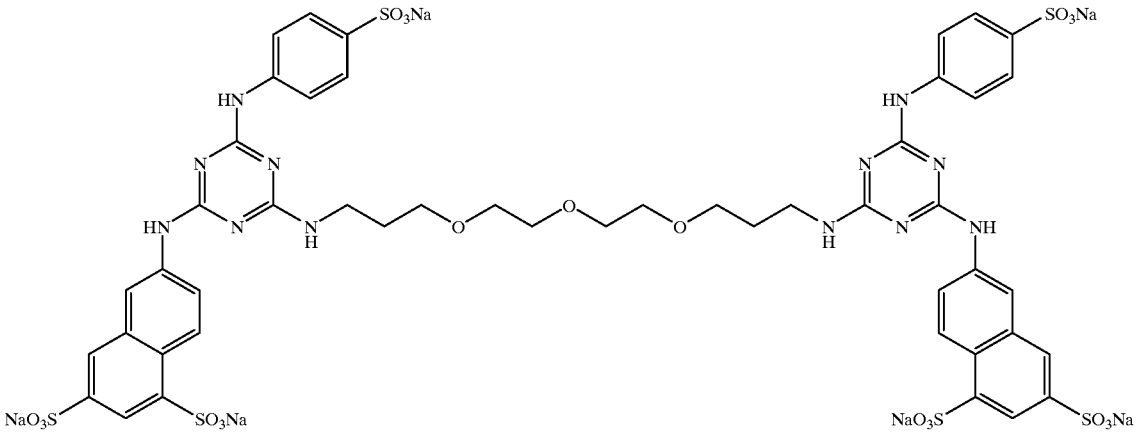

-continued
Compound 9
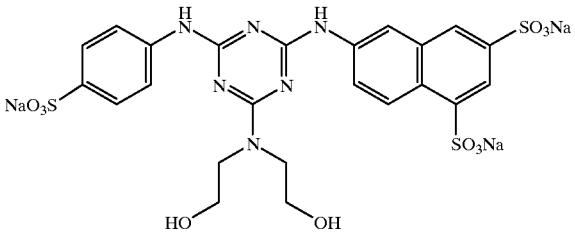
Compound 10
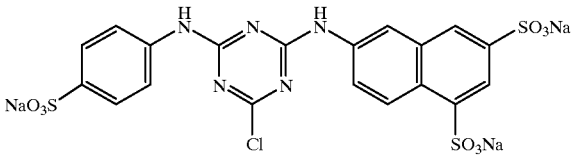
Compound 11
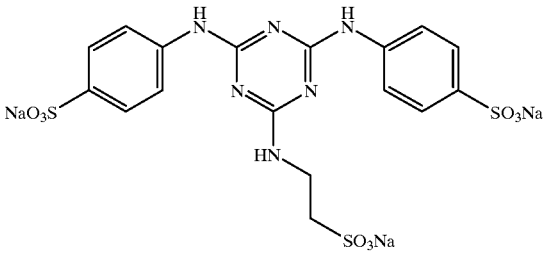
-continued
Compound 12
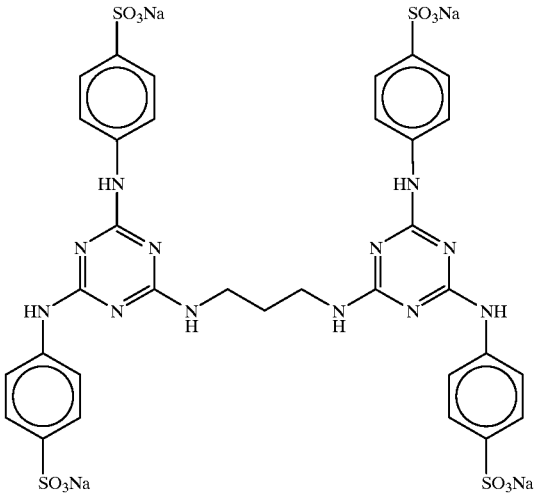
Compound 13
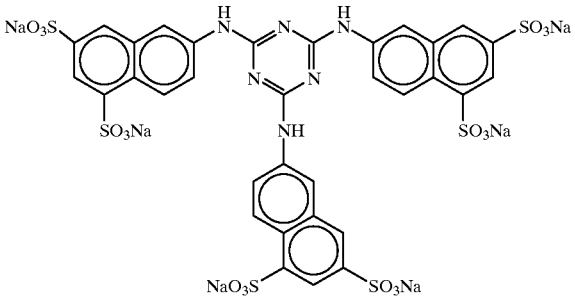
Compound 14
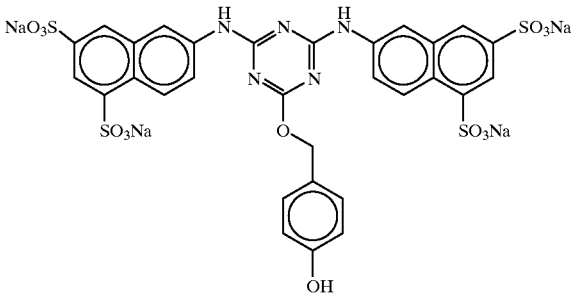
Compound 15
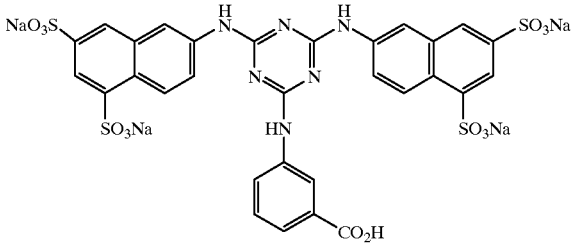
Compound 16
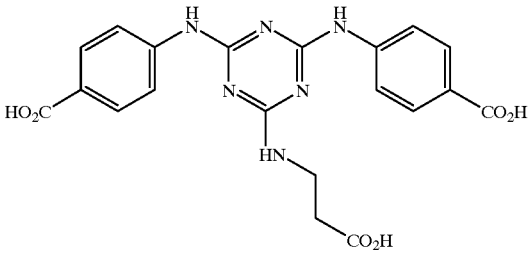

-continued

Compound 17

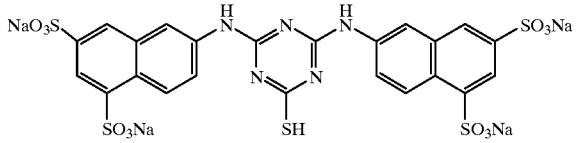

Compound 1 is preferred in the practice of this invention when it is used in a photographic fixing composition.

As noted above, the photographic spectral sensitizing dye stain reducing agents described herein can be used individually or in a mixture in one or more photographic processing compositions. Generally, such processing compositions are used in providing a color image in imagewise exposed photographic silver halide materials, including but not limited to, color reversal films, color negative films, color papers (including positive and negative color papers), motion imaging films and prints (including intermediate films). Such films and papers are well known in the art, having been described in hundreds of publications in various countries of the world, and being commercialized as dozens of different products from several manufacturing companies such as Eastman Kodak Company, Konica Photo Co., Fuji Photo Co, AGFA, Sakura and Imation Co. Such materials can also include magnetic layers, particularly on the non-emulsion side, such as in ADVANCED PHOTO SYSTEM™ photographic materials (including KODAK ADVANTiX™ films).

Generally, in the processing of color photographic materials to provide negative or positive color images, the materials are imagewise exposed in a suitable fashion using a suitable imaging source (tungsten lamps, sunlight, lasers and phosphors). The imagewise exposed materials are then processed in a series of wet photographic processing baths in a suitable sequence of steps to initiate various chemical reactions in the silver halide and color-forming materials to generate the desired images.

For obtaining color images, processing methods include at the least, a color development step, a bleaching step, a fixing step (or a combined bleach-fixing step), and a rinsing or color stabilizing step. Some of the processing methods will include additional steps, for example a black-and-white developing step and pre-bleaching step or conditioning step to provide a positive color image in color reversal films. Motion picture films and prints may include still other processing steps. However, all of these steps and the conventional components of the processing compositions are well known, as described for example, in *Research Disclosure* publication 308119, December 1989, publication 17643, December 1978, and publication 38957, September, 1996. *Research Disclosure* is a publication of Kenneth Mason Publications Ltd., Dudley House, 12 North Street, Emsworth, Hampshire PO10 7DQ England (or Emsworth Design Inc., 121 West 19th street, New York, N.Y. 10011). Some additional details are provided below in describing such compositions, but additional details can be supplied from the many publications listed in the noted *Research Disclosure* publication.

The spectral sensitizing dyes typically present in color photographic materials are described in numerous publications including for example, U.S. Pat. No. 5,747,236 (Farid et al), incorporated herein for its teaching about spectral sensitizing dyes. Classes of such dyes include, but are not limited to, cyanines and merocyanines.

The spectral sensitizing dye stain reducing agents useful in this invention can be present in one or more photographic processing compositions used in one or more photographic processing steps. The same or different mixtures of such compounds can be used in one or more of these photographic processing steps, in the same or different concentrations.

In addition, the present invention includes a mere aqueous solution of one or more of these compounds. This aqueous composition can be used at any stage of photoprocessing. Such compositions need not necessarily include any photochemicals.

As used herein, "photographic processing composition" refers to a composition in liquid, solid or multi-phase form that is used in one or more photographic processing steps and that contains one or more "photochemicals" that participate, facilitate or otherwise foster a photochemical reaction or physical benefit in the photographic processing step. In most instances, the photochemicals are involved in some type of chemical reaction within the processed photographic material, or in the processing composition itself. Examples of such photochemicals include, but are not limited to, black-and-white developing agents, co-developing agents, color developing agents, bleaching agents, fixing agents, dye stabilizing agents, fixing accelerators, bleaching accelerators, antifoggants, fogging agents and development accelerators. In other instances, the photochemicals may provide a physical benefit such as reduced scumming, reduced crystal growth on processing equipment, reduced sludge, reduced film residue or spotting, storage stability and reduced biogrowth. Examples of such photochemicals include, but are not limited to, surfactants, antioxidants, crystal growth inhibitors and biocides.

Photographic color developing compositions of this invention typically include one or more color developing agents and various other conventional addenda including preservatives or antioxidants (including sulfites, and hydroxylamine and its derivatives), sulfites, metal ion sequestering agents, corrosion inhibitors and buffers. These materials can be present in conventional amounts. For example, the color developing agent is generally present in an amount of at least 0.001 mol/l (preferably at least 0.01 mol/l), and an antioxidant or preservative for the color developing agent is generally present in an amount of at least 0.0001 mol/l (preferably at least 0.001 mol/l). The pH of the composition is generally from about 9 to about 13, and preferably from about 11.5 to about 12.5.

Exemplary color developing compositions and components (except the sensitizing dye stain reducing agents described herein) are described for example, in EP-A-0 530 921 (Buongiorne et al), U.S. Pat. No. 5,037,725 (Cullinan et al), U.S. Pat. No. 5,552,264 (Cullinan et al), U.S. Pat. No. 5,508,155 (Marrese et al), U.S. Pat. No. 4,892,804 (Vincent et al), U.S. Pat. No. 4,482,626 (Twist et al), U.S. Pat. No. 4,414,307 (Kapecki et al), in U.S. Pat. No. 4,876,174 (Ishikawa et al), U.S. Pat. No. 5,354,646 (Kobayashi et al) and U.S. Pat. No. 4,264,716 (Vincent et al), all incorporated herein for their teaching about color developing compositions.

Useful preservatives in the color developing compositions include sulfites (such as sodium sulfite, potassium sulfite, sodium bisulfite and potassium metabisulfite), hydroxylamines and its derivatives, especially those derivatives having substituted or unsubstituted alkyl or aryl groups, hydrazines, hydrazides, amino acids, ascorbic acid (and derivatives thereof), hydroxamic acids, aminoketones, mono- and polysaccharides, mono- and polyamines, quaternary ammonium salts, nitroxy radicals, alcohols, and oximes. More particularly useful hydroxylamine derivatives include substituted and unsubstituted monoalkyl- and dialkylhydroxylamines (especially those substituted with sulfo, carboxy, phospho, hydroxy, carbonamido, sulfonamido or other solubilizing groups). Mixtures of compounds from the same or different classes of antioxidants can also be used if desired.

Examples of useful antioxidants are described for example, in U.S. Pat. No. 4,892,804 (noted above), U.S. Pat. No. 4,876,174 (noted above), U.S. Pat. No. 5,354,646 (noted above), U.S. Pat. No. 5,660,974 (Marrese et al), and U.S. Pat. No. 5,646,327 (Burns et al), the disclosures of which are all incorporated herein by reference for description of useful antioxidants. Many of these antioxidants are mono- and dialkylhydroxylamines having one or more substituents on one or both alkyl groups. Particularly useful alkyl substituents include sulfo, carboxy, amino, sulfonamido, carbonamido, hydroxy and other solubilizing substituents.

Most preferably, the noted hydroxylamine derivatives can be mono- or dialkylhydroxylamines having one or more hydroxy substituents on the one or more alkyl groups. Representative compounds of this type are described for example in U.S. Pat. No. 5,709,982 (Marrese et al), incorporated herein by reference, as having the Structure II:

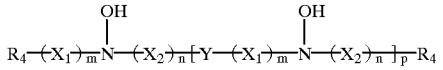

wherein $R_4$ is hydrogen, a substituted or unsubstituted alkyl group of 1 to 10 carbon atoms, a substituted or unsubstituted hydroxyalkyl group of 1 to 10 carbon atoms, a substituted or unsubstituted cycloalkyl group of 5 to 10 carbon atoms, or a substituted or unsubstituted aryl group having 6 to 10 carbon atoms in the aromatic nucleus.

$X_1$ is —$CR_2(OH)CHR_5$— and $X_2$ is —$CHR_5CR_6(OH)$— wherein $R_5$ and $R_6$ are independently hydrogen, hydroxy, substituted or unsubstituted alkyl groups or 1 or 2 carbon atoms, substituted or unsubstituted hydroxyalkyl groups of 1 or 2 carbon atoms, or $R_5$ and $R_6$ together represent the carbon atoms necessary to complete a substituted or unsubstituted 5- to 8-membered saturated or unsaturated carbocyclic ring structure.

Y is a substituted or unsubstituted alkylene group having at least 4 carbon atoms, and has an even number of carbon atoms, or Y is a substituted or unsubstituted divalent aliphatic group having an even total number of carbon and oxygen atoms in the chain, provided that the aliphatic group has a least 4 atoms in the chain.

Also in Structure II, m, n and p are independently 0 or 1. Preferably, each of m and n is 1, and p is 0.

Specific di-substituted hydroxylamine antioxidants include, but are not limited to: N,N-bis(2,3-dihydroxypropyl)hydroxylamine, N,N-bis(2-methyl-2,3-dihydroxypropyl)hydroxylamine and N,N-bis(1-hydroxymethyl-2-hydroxy-3-phenylpropyl)hydroxylamine. The first compound is preferred.

Particularly useful color developing agents include aminophenols, p-phenylenediamines (especially N,N-dialkyl-p-phenylenediamines) and others which are well known in the art, such as EP 0 434 097A1 (published Jun. 26, 1991) and EP 0 530 921A1 (published Mar. 10, 1993).

Preferred color developing agents include, but are not limited to, N,N-diethyl p-phenylenediamine sulfate (KODAK Color Developing Agent CD-2), 4-amino-3-methyl-N-(2-methane sulfonamidoethyl)aniline sulfate, 4-(N-ethyl-N-β-hydroxyethylamino)-2-methylaniline sulfate (KODAK Color Developing Agent CD-4), p-hydroxyethylethylaminoaniline sulfate, 4-(N-ethyl-N-2-methanesulfonylaminoethyl)-2-methylphenylenediamine sesquisulfate (KODAK Color Developing Agent CD-3), 4-(N-ethyl-N-2-methanesulfonylaminoethyl)-2-methylphenylenediamine sesquisulfate, and others readily apparent to one skilled in the art. A most preferred color developing agent is KODAK Color Developing Agent CD-3 for the processing of color reversal materials.

Photographic bleaching compositions of this invention generally include one or more persulfate, peracid (such as hydrogen peroxide, periodates or percarbonates) or high metal valent ion bleaching agents, such as iron(II) complexes with simple anions (such as nitrate, sulfate, and acetate), or with carboxylic acid or phosphonic acid ligands. Particularly useful bleaching agents include iron complexes of one or more aminocarboxylic acids, aminopolycarboxylic acids, polyaminocarboxylic acids or polyaminopolycarboxylic acids, or salts thereof. Particularly useful chelating ligands include conventional polyaminopolycarboxylic acids including ethylenediaminetetraacetic acid and others described in *Research Disclosure*, noted above, U.S. Pat. No. 5,582,958 (Buchanan et al) and U.S. Pat. No. 5,753,423 (Buongiorne et al). Biodegradable chelating ligands are also desirable because the impact on the environment is reduced. Useful biodegradable chelating ligands include, but are not limited to, iminodiacetic acid or an alkyliminodiacetic acid (such as methyliminodiacetic acid), ethylenediaminedisuccinic acid and similar compounds as described in EP-A-0 532,003, and ethylenediamine monosuccinic acid and similar compounds as described in U.S. Pat. No. 5,691,120 (Wilson et al), all of which are incorporated herein by reference in relation to their description of bleaching agents.

These and many other such complexing ligands known in the art including those described in U.S. Pat. No. 4,839,262 (Schwartz), U.S. Pat. No. 4,921,779 (Cullinan et al), U.S. Pat. No. 5,037,725 (noted above), U.S. Pat. No. 5,061,608 (Foster et al), U.S. Pat. No. 5,334,491 (Foster et al), U.S. Pat. No. 5,523,195 (Darmon et al), U.S. Pat. No. 5,582,958 (Buchanan et al), U.S. Pat. No. 5,552,264 (noted above), U.S. Pat. No. 5,652,087 (Craver et al), U.S. Pat. No. 5,928,844 (Feeney et al) U.S. Pat. No. 5,652,085 (Wilson et al), U.S. Pat. No. 5,693,456 (Foster et al), U.S. Pat. No. 5,834,170 (Craver et al), and U.S. Pat. No. 5,585,226 (Strickland et al), all incorporated herein by reference for their teaching of bleaching compositions. The total amount of bleaching agent(s) in the composition is generally at least 0.0001 mol/l, and preferably at least 0.05 mol/l. These amounts are also useful for bleach-fixing compositions of this invention.

Other components of the bleaching solution include buffers, halides, corrosion inhibiting agents, and metal ion sequestering agents. These and other components and conventional amounts are described in the references in the preceding paragraph. The pH of the bleaching composition is generally from about 4 to about 6.5.

Particularly useful bleaching agents are ferric ion complexes of one or more of ethylenediaminetetraacetic acid (EDTA), ethylenediaminedisuccinic acid (EDDS, particularly the S,S-isomer), methyliminodiacetic acid (MIDA) or other iminodiacetic acids, β-alaninediacetic acid (ADA), ethylenediaminemonosuccinic acid (EDMS), 1,3-propylenediaminetetraacetic acid (PDTA), nitrilotriacetic acid (NTA), and 2,6-pyridinedicarboxylic acid (PDCA). The most preferred bleaching agent is a ferric ion complex of EDTA for processing color reversal materials. For processing color negative materials and color papers, a ferric complex of PDTA is preferred. Multiple bleaching agents can be present if desired.

Photographic fixing compositions are the preferred photographic processing compositions of this invention for eliminating spectral sensitizing dye stain.

Useful fixing agents for photographic fixing compositions are well known. Examples of photographic fixing agents include, but are not limited to, thiosulfates (for example sodium thiosulfate, potassium thiosulfate and ammonium thiosulfate), thiocyanates (for example sodium thiocyanate, potassium thiocyanate and ammonium thiocyanate), thioethers (such as ethylenebisthioglycolic acid and 3,6-dithia-1,8-octanediol), imides and thiourea. Thiosulfates and thiocyanates are preferred, and thiosulfates are more preferred. Ammonium thiosulfate is most preferred. The general amount of total fixing agents in the fixing composition of this invention is at least 0.001 mol/l, and preferably at least 0.1 mol/l. These amounts are also useful for the bleach-fixing compositions of this invention.

It is also known to use fixing accelerators in fixing compositions. Representative fixing accelerators include, but are not limited to, ammonium salts, guanidine, ethylenediamine and other amines, quaternary ammonium salts and other amine salts, thiourea, thioethers, thiols and thiolates. Examples of useful thioether fixing accelerators are described in U.S. Pat. No. 5,633,124 (Schmittou et al), incorporated herein for the teaching of fixing compositions.

The fixing compositions of this invention generally contain one or more monovalent or divalent cations supplied by various salts used for various purposes (for example, salts of fixing agents). It is preferred that the cations be predominantly ammonium cations, that is at least 50% of the total cations are ammonium ions. Such fixing compositions are generally known as "high ammonium" fixing compositions.

The fixing compositions of this invention can also include one or more of various addenda optionally but commonly used in such compositions for various purposes, including hardening agents, preservatives (such as sulfites or bisulfites), metal sequestering agents (such as polycarboxylic acids and organophosphonic acids), buffers, and fixing accelerators. The amounts of such addenda in the working strength compositions would be readily known to one skilled in the art.

The desired pH of the fixing compositions is 8 or less, and can be achieved and maintained using any useful combination of acids and bases, as well as various buffers.

Other details of fixing compositions not explicitly described herein are considered well known in the art, and are described for example, in *Research Disclosure* publication 38957 (noted below), and publications noted therein in paragraph XX(B), U.S. Pat. No. 5,424,176 (Schmittou et al), U.S. Pat. No. 4,839,262 (noted above), U.S. Pat. No. 4,921,779 (noted above), U.S. Pat. No. 5,037,725 (noted above), U.S. Pat. No. 5,523,195 (noted above), U.S. Pat. No. 5,552,264 (noted above), all incorporated herein by reference for their teaching of fixing compositions.

During fixing, the fixing composition in the processor may accumulate dissolved silver halide, and other substances that are extracted from the processed photographic element. Such materials, and particularly silver halide, can be removed using known means, such as ion exchange, electroysis, electrodialysis and precipitation.

Another photographic processing composition of this invention is a dye stabilizing composition containing one or more photographic imaging dye stabilizing compounds. Such compositions can be used at the end of the processing sequence (such as for color negative films and color papers), or in another part of the processing sequence (such as between color development and bleaching as a pre-bleaching composition).

Such dye stabilizing compositions generally have a pH of from about 5.5 to about 8, and include a dye stabilization compound (such as an alkali metal formaldehyde bisulfite, hexamethylenetetramine, various benzaldehyde compounds, and various other formaldehyde releasing compounds), buffering agents, bleach-accelerating compounds, secondary amines, preservatives, and metal sequestering agents. All of these compounds and useful amounts are well known in the art, including U.S. Pat. No. 4,839,262 (Schwartz), U.S. Pat. No. 4,921,779 (noted above), U.S. Pat. No. 5,037,725 (noted above), U.S. Pat. No. 5,523,195 (noted above) and U.S. Pat. No. 5,552,264 (noted above), all incorporated herein by reference for their teaching of dye stabilizing compositions. Generally, one or more photographic dye stabilizing compounds are present in an amount of at least 0.0001 mol/l.

A preferred dye-stabilizing composition includes sodium formaldehyde bisulfite as a dye stabilizing compound, and thioglycerol as a bleach-accelerating compound. More preferably, this composition is used as a pre-bleaching composition during the processing of color reversal photographic materials.

In some processing embodiments of this invention, a dye stabilizing composition or final rinsing composition of this invention is used to clean the processed photographic material as well as to stabilize the color image. Either type of composition generally includes one or more anionic, nonionic, cationic or amphoteric surfactants, and in the case of dye stabilizing compositions, one or more dye stabilizing compounds as described above. Particularly useful dye stabilizing compounds useful in these dye stabilizing compositions are described for example in EP-A-0 530 832 (Koma et al) and U.S. Pat. No. 5,968,716 (McGuckin et al). Other components and their amounts for both dye stabilizing and final rinsing compositions are described in U.S. Pat. No.

5,952,158 (McGuckin et al), U.S. Pat. No. 3,545,970 (Giorgianni et al), U.S. Pat. No. 3,676,136 (Mowrey), U.S. Pat. No. 4,786,583 (Schwartz), U.S. Pat. No. 5,529,890 (McGuckin et al), U.S. Pat. No. 5,578,432 (McGuckin et al), U.S. Pat. No. 5,534,396 (noted above), U.S. Pat. No. 5,645,980 (McGuckin et al), U.S. Pat. No. 5,667,948 (McGuckin et al), U.S. Pat. No. 5,750,322 (McGuckin et al) and U.S. Pat. No. 5,716,765 (McGuckin et al), all of which are incorporated by reference for their teaching of such compositions.

The photoprocessing compositions of this invention include one or more spectral sensitizing dye stain reducing agents at a total concentration of at least $5\times10^{-5}$ mol/l, and preferably of at least $1o^{-4}$ mol/l. The maximum concentration of such compounds will vary depending upon the amount of sensitizing dye in the processed photographic material, the cost of the compounds, and their solubility, and can be readily determined by a skilled worker in the art. General and preferred concentrations of the compounds in various compositions are described below in TABLE I. The endpoints of all ranges are considered approximate so that they should be interpreted as "about" the noted amounts. For the last solution*, the spectral sensitizing dye stain reducing compound(s) is essentially the only component.

TABLE I

| COMPOSITION | GENERAL (mol/l) | PREFERRED (mol/l) |
|---|---|---|
| Color Developing | 0.0001–0.01 | 0.001–0.005 |
| Pre-bleaching | 0.0001–0.01 | 0.001–0.005 |
| Bleaching | 0.00005–0.001 | 0.0001–0.001 |
| Fixing | 0.00005–0.001 | 0.0001–0.001 |
| Bleach-fixing | 0.0001–0.001 | 0.001–0.005 |
| Dye Stabilizing | 0.0001–0.01 | 0.001–0.005 |
| Final Rinsing | 0.0001–0.01 | 0.001–0.005 |
| Washing solution* | 0.00005–0.001 | 0.0001–0.001 |

Representative sequences for processing various color photographic materials are described for example in *Research Disclosure* publication 308119, December 1989, publication 17643, December 1978, and publication 38957, September 1996.

As noted above, the compositions of the present invention are used to process color photographic elements, including but not limited to, color negative photographic films, color reversal photographic films, and color photographic papers. The general sequence of steps and conditions (times and temperatures) for processing are well known as Process C-41 and Process ECN-2 for color negative films, Process E-6 and Process K-14 for color reversal films, Process ECP for color prints, and Process RA-4 for color papers.

For example, color negative films that can be processed using the compositions of this invention include, but are not limited to, KODAK ROYAL GOLD™ films, KODAK GOLD™ films, KODAK PRO GOLD™ films, KODAK FUNTIME™, KODAK EKTAPRESS PLUS™ films, EASTMAN EXR™ films, KODAK ADVANTiX™ films, FUJI SUPER G Plus films, FUJI SMARTFILM™ products, FUJICOLOR NEXIA™ films, KONICA VX films, KONICA SRG3200 film, 3M SCOTCH™ ATG films, and AGFA HDC and XRS films. Films processing according to this invention can also be those incorporated into what are known as "single-use cameras".

In addition, color papers that can be processed using the compositions of this invention include, but are not limited, KODAK EKTACOLOR EDGE V, VII and VIII Color Papers (Eastman Kodak Company), KODAK ROYAL VII Color Papers (Eastman Kodak Company), KODAK PORTRA III, IIIM Color Papers (Eastman Kodak Company), KODAK SUPRA III and IIIM Color Papers (Eastman Kodak Company), KODAK ULTRA III Color Papers (Eastman Kodak Company), FUJI SUPER Color Papers (Fuji Photo Co., FA5, FA7 and FA9), FUJI CRYSTAL ARCHIVE and Type C Color Papers (Fuji Photo Co.), KONICA COLOR QA Color Papers (Konica, Type QA6E and QA7), and AGFA TYPE II and PRESTIGE Color Papers (AGFA). The compositions and constructions of such commercial color photographic elements would be readily determined by one skilled in the art.

KODAK DURATRANS, KODAK DURACLEAR, KODAK EKTAMAX RAL and KODAK DURAFLEX photographic materials, and KODAK Digital Paper Type 2976 can also be processed using the present invention.

More preferably, the compositions of the present invention are used to provide positive color images in color reversal photographic films. The typical sequence of steps includes first development (black-and-white development), reversal processing step, color developing, bleaching, fixing, and stabilizing. There may be various washing steps between other steps, as well as a pre-bleach step or conditioning step before bleaching. Alternatively, dye stabilizing can occur between color developing and bleaching. Many details of such processes are provided in U.S. Pat. No. 5,552,264 (noted above), incorporated herein by reference. Other details are provided in *Research Disclosure,* publication 38957 (noted above), and references noted therein. Useful reversal compositions are described, for example, in U.S. Pat. No. 3,617,282 (Bard et al), U.S. Pat. No. 5,736,302 (Buongiorne et al) and U.S. Pat. No. 5,811,225 (McGuckin et al).

The first developing step is usually carried out using a conventional black-and-white developing solution that can contain black-and-white developing agents, auxiliary co-developing agents, preservatives, antifoggants, antisludging agents, buffers and other conventional addenda. Useful first developing compositions are described for example, in U.S. Pat. No. 5,298,369 (Munshi et al), and U.S. Pat. No. 5,552,264 (noted above).

Color reversal films preferably processed with the compositions of the practice of this invention are comprised of a support having thereon a plurality of photosensitive silver halide emulsion layers that can contain any conventional silver halide (or mixture thereof). Such films generally have silver halide emulsions having at least 1 mol % iodide based on total silver. Some specific commercially available color reversal photographic films that can be processed using this invention include EKTACHROME Color Reversal Films (Eastman Kodak Company), FUJICHROME Color Reversal Films (Fuji Photo Film Co., Ltd.), AGFACHROME Color Reversal Films (AGFA) and KONICACHROME Color Reversal Films (Konica).

The various processing steps, including color developing, bleaching and fixing can be carried out using single working strength composition baths (single stage), or multistage systems having multiple baths of the same processing composition. Agitation or recirculation can also be used in one or more steps if desired. Processing can also be carried out using any known method for contacting the processing composition of this invention and the photographic element. Such methods include, but are not limited to, immersing the photographic element in the working strength composition, laminating a cover sheet containing the composition to the photographic element, and applying the composition by high velocity jet or spraying.

Any of the compositions of this invention can be replenished at any suitable replenishment rate, for example, from about 20 to about 2000 ml/m$^2$.

Processing can be carried out using any suitable processing equipment, including deep tank processors, and "low volume thin tank" processes including rack and tank and automatic tray designs, as described for example in U.S. Pat. No. 5,436,118 (Carli et al), and publications noted therein. Thus, processing can be carried out in large-scale processing labs, or in what are known as "mini-labs" that are normally placed in smaller environments. Rotary tube processors can also be used for processing photographic materials.

The following examples are provided to illustrate the invention, and not to be limiting in any fashion.

EXAMPLE 1

Color Reversal Processing Using Fixing Compositions

A useful spectral sensitizing dye stain reducing agent Compound 1 was dissolved in samples of a conventional Process E-6 Fixer composition (available from Eastman Kodak Company) to provide fixing compositions of this invention. Samples of commercially available KODAK EKTACHROME Elite II 100 film were given a uniform exposure, two stops greater than that normally used for $D_{min}$. They were then processed using the commercial Process E-6 (shown below) and conventional processing compositions for that process in a sinkline processor, except that the fixing composition was modified to contain Compound 1 ("Additive").

After processing, the transmission spectra of the film samples were recorded, and from these spectra the CIELAB parameters were calculated. The CIELAB results are listed in TABLE II. The parameter of interest is A* that represents the red to green axis in color space. The more negative the value of A* the less pink is the appearance of the film sample, indicating removal of the spectral sensitizing dyes and less spectral sensitizing dye stain. From many replicates, the reproducibility of the A* measurement was found to be ±0.2. Therefore, any reduction in A* greater than 0.2 represents a significant improvement in sensitizing dye stain reduction. "Delta A" represents the difference in A* between the film processed in a fixing composition of this invention and the film processed using the conventional Kodak Process E-6 Fixer.

TABLE II

| Film Sample No. | Fixing Composition & Additive | A* | Delta A* |
|---|---|---|---|
| 1 | Control - regular Process E-6 fixing | −0.8271 | |
| 2 | Control - regular Process E-6 fixing | −1.036 | |
| 3 | 0.11 mmol Compound 1 | −2.6654 | −1.7 |
| 4 | 0.11 mmol Compound 1 | −2.1905 | −1.3 |
| 5 | 0.23 mmol Compound 1 | −2.8353 | −1.9 |
| 6 | 0.23 mmol Compound 1 | −2.7215 | −1.8 |
| 7 | 0.34 mmol Compound 1 | −3.0258 | −2.1 |
| 8 | 0.34 mmol Compound 1 | −3.0203 | −2.1 |
| 9 | 0.46 mmol Compound 1 | −3.4901 | −2.6 |
| 10 | 0.46 mmol Compound 1 | −3.2781 | −2.3 |

Reduction in the variability of the spectral sensitizing dye stain due to variations in wash time and temperature is also desirable. The standard deviation of the A* measurement over a standard series of wash times (from 2 to 15 minutes at temperatures of 24–40° C.) following the fixing step in the process is another indicator of the effectiveness of the spectral sensitizing dye stain reducing agent (for example Compound 1). A smaller standard deviation indicates a more effective compound. For many replicates, the reproducibility of the standard deviation was found to be about ±0.1. Therefore, any reduction in A* standard deviation greater than 0.1 represents a significant improvement in spectral sensitizing dye stain reduction. The results in the following TABLE III are for the use of Compound 1 and the use of Commercial Process E-6

| PROCESSING STEP | PROCESSING COMPOSITION | PROCESSING TIME | PROCESSING TEMPERATURE |
|---|---|---|---|
| First Development | KODAK First Developer, Process E-6 | 360 seconds | 38° C. |
| Washing | Water | 120 seconds | 38° C. |
| Reversal bath | KODAK Process E-6 AR Reversal Bath & Replenisher | 120 seconds | 38° C. |
| Color Development | KODAK Color Developer, Process E-6 | 360 seconds | 38° C. |
| Conditioning or Pre-bleaching | KODAK Prebleach Replenisher II, Process E-6 | 120 seconds | 38° C. |
| Bleaching | KODAK Bleach, Process E-6 | 360 seconds | 30–38° C. |
| Fixing | KODAK Fix, Process E-6 | 240 seconds | 30–38° C. |
| Washing | Water | 240 seconds | 30–38° C. |
| Stabilizing or Final rinsing | KODAK Final Rinse & Replenisher, Process E-6AR | 60 seconds | 30–38° C. |

PHORWITE REU optical brightener that is a known spectral sensitizing dye stain reducing agent in conventional Process RA-4 color paper color developing compositions. The data show that Compound 1, when added to the fixing composition, is effective for reducing the spectral sensitizing dye stain in film samples.

TABLE III

| Additive | Amount | Average A* | Standard Deviation A* |
|---|---|---|---|
| None | 0 | −1.2 | 1.52 |
| PHORWITE REU (control) | 1.0 g/l | −2.5 | 1.22 |
| Compound 1 (invention) | 0.5 g/l | −2.6 | 1.07 |
| Compound 1 (invention) | 1.0 g/l | −3.1 | 0.91 |

EXAMPLE 2

Additional Fixing Compositions and Use in Reversal Processing

The processing of Example 1 was followed exactly except that the fixing compositions contained various spectral sensitizing dye stain reducing agents within the scope of the present invention. The results of processing samples of KODAK EKTACHROME Elite II 100 Color Reversal Film are shown in the following TABLE IV.

TABLE IV

| Stain Reducing Compound | Concentration | A* | Delta A* |
|---|---|---|---|
| 2 | 0.34 mmol/l | −3.1864 | −2.0 |
| 3 | 0.34 mmol/l | −2.6272 | −1.9 |
| 4 | 0.34 mmol/l | −3.2135 | −2.5 |
| 5 | 0.34 mmol/l | −3.1276 | −2.4 |
| 8 | 0.75 mmol/l | −1.7837 | −0.7 |
| 9 | 1.5 mmol/l | −3.0401 | −1.8 |
| 10 | 0.75 mmol/l | −2.6283 | −1.6 |
| 11 | 0.70 mmol/l | −2.1802 | −1.1 |
| 12 | 1.5 mmol/l | −2.2947 | −1.0 |
| 13 | 0.34 mmol/l | −2.3736 | −1.2 |
| 14 | 0.34 mmol/l | −2.7847 | −1.6 |
| 15 | 0.34 mmol/l | −3.1655 | −2.0 |
| 16 | 0.68 mmol/l | −1.7139 | −1.0 |
| 17 | 0.34 mmol/l | −2.6184 | −1.9 |

EXAMPLE 3

Color Reversal Processing Using A Bleaching Composition

An experiment was conducted like that described in Examples 1–2 to process imagewise exposed samples of the color reversal film, except that Compound 1 was added to the conventional Process E-6 bleaching composition to provide compositions of this invention. The conventional Process E-6 fixing composition was also used. The results are shown in TABLE V below.

TABLE V

| Film Sample No. | Bleaching Composition/Additive | A* | Delta A* |
|---|---|---|---|
| 1 | Control - regular bleaching | −1.1138 | |
| 2 | Control - regular bleaching | −1.0775 | |
| 3 | 0.11 mmol Compound 1 | −1.9981 | −0.9 |
| 4 | 0.11 mmol Compound 1 | −1.9297 | −0.8 |
| 5 | 0.23 mmol Compound 1 | −2.6363 | −1.5 |
| 6 | 0.23 mmol Compound 1 | −2.7784 | −1.7 |
| 7 | 0.34 mmol Compound 1 | −3.157 | −2.1 |
| 8 | 0.34 mmol Compound 1 | −3.0237 | −1.9 |
| 9 | 0.46 mmol Compound 1 | −3.6496 | −2.6 |
| 10 | 0.46 mmol Compound 1 | −3.4782 | −2.4 |

EXAMPLE 4

Color Reversal Processing Using A Pre-bleaching Composition

An experiment was conducted like that described in Examples 1–2 to process imagewise exposed commercial color reversal film samples, except that Compound 1 was added to the commercial Process E-6 pre-bleaching composition (instead of the fixing composition) to provide compositions of this invention. The results are shown in TABLE VI below.

TABLE VI

| Film Sample No. | Pre-bleaching Composition/Additive | A* | Delta A* |
|---|---|---|---|
| 1 | Control - regular pre-bleaching | −0.3597 | |
| 2 | Control - regular pre-bleaching | −0.6918 | |
| 3 | 0.34 mmol Compound 1 | −0.707 | −0.2 |
| 4 | 0.34 mmol Compound 1 | −0.8976 | −0.4 |
| 5 | 1.70 mmol Compound 1 | −2.037 | −1.5 |
| 6 | 1.70 mmol Compound 1 | −1.9332 | −1.4 |
| 7 | 3.40 mmol Compound 1 | −2.775 | −2.2 |
| 8 | 3.40 mmol Compound 1 | −2.6382 | −2.1 |

These results show that the addition of Compound 1 to the pre-bleaching composition in concentrations of 1.7 and 3.4 mmol significantly reduced the amount of spectral sensitizing dye stain in the film samples.

EXAMPLE 5

Color Reversal Processing Using A Color Developing Composition

An experiment was conducted like that described in Example 1 to process imagewise exposed color reversal film samples except that Compound 1 was added to the Process E-6 color developing composition (instead of the fixing composition) to provide a composition of this invention. The results are shown in TABLE VII below.

TABLE VII

| Film Sample No. | Color Developing Composition/Additive | A* | Delta A* |
|---|---|---|---|
| 1 | Control - regular color development | −1.1565 | |
| 2 | Control - regular color development | −1.0051 | |
| 3 | 0.34 mmol Compound 1 | −1.4219 | −0.3 |
| 4 | 0.34 mmol Compound 1 | −1.6179 | −0.5 |

TABLE VII-continued

| Film Sample No. | Color Developing Composition/Additive | A* | Delta A* |
|---|---|---|---|
| 5 | 1.70 mmol Compound 1 | −2.3146 | −1.2 |
| 6 | 1.70 mmol Compound 1 | −2.3384 | −1.3 |
| 7 | 3.40 mmol Compound 1 | −2.6681 | −1.6 |
| 8 | 3.40 mmol Compound 1 | −2.6303 | −1.5 |

These results show that the addition of Compound 1 to the color developing composition at a concentration of 0.34 mmol slightly reduced the amount of spectral sensitizing dye stain in the film samples. The addition of Compound 1 to the color developing composition in concentrations of 1.7 and 3.4 mmol significantly reduced the amount of spectral sensitizing dye stain in the film samples.

Reduction in the variability of the spectral sensitizing dye stain due to variations in wash time and temperature is also desirable. The standard deviation of the A* measurement over a standard series of final wash times (from 2 to 15 minutes at temperatures of 24–40° C.) following the color development (and subsequent intervening) step in the process is another indicator of the effectiveness of the spectral sensitizing dye stain reducing agent. A smaller standard deviation indicates a more effective compound. For many replicates, the reproducibility of the standard deviation was found to be about ±0.1. Therefore, any reduction in A* standard deviation greater than 0.1 represents a significant improvement in spectral sensitizing dye stain reduction. The results in the following TABLE VIII are for the use of Compound 1 and the use of conventional PHORWITE REU optical brightener. The data show that Compound 1 is effective at reducing spectral sensitizing dye stain in the film samples.

TABLE VIII

| Additive | Amount | Average A* | Standard Deviation A* |
|---|---|---|---|
| None | 0 | −2.1 | 1.13 |
| PHORWITE REU (control) | 1.0 g/l | −2.5 | 1.00 |
| Compound 1 (invention) | 1.0 g/l | −2.5 | 0.99 |

EXAMPLE 6

Color Negative Processing Using A Bleaching Composition

Compound 1 was dissolved in solutions of the standard Process C-41 KODAK FLEXICOLOR Bleach (Eastman Kodak Company) to provide bleaching compositions of this invention. Unexposed samples of commercial KODAK Gold Max 800 film samples were processed so that no image dye was formed in the process. The film samples were processed using the conventional Process C-41 and photoprocessing solutions (shown below) in a sinkline processor, but the bleaching composition of this invention was used.

Commerical Process C-41

| PROCESSING STEP | PROCESSING COMPOSITION | PROCESSING TIME | PROCESSING TEMPERATURE |
|---|---|---|---|
| Color development | KODAK FLEXICOLOR Developer | 195 seconds | 38° C. |
| Bleaching | KODAK FLEXICOLOR Bleach III | 240 seconds | 38° C. |
| Washing | Water | 60 seconds | 38° C. |
| Fixing | KODAK FLEXICOLOR Fixer & Replenisher | 240 seconds | 38° C. |
| Washing | Water | 180 seconds | 38° C. |
| Stabilizing or Final rinsing | KODAK FLEXICOLOR Stabilizer & Replensher LF | 15 seconds | 38° C. |

After processing, the transmission spectra of the films were recorded, and from these spectra the CIELAB parameters were calculated. The CIELAB results are listed in TABLE IX below. As noted above, A* is the parameter of interest. Because of the background color in these films, the absolute values of A* were considerably different from those of the color reversal films. However, a reduction in A* still indicates less retained spectral sensitizing dye and a reduction in A* greater than 0.2 represents a measurable improvement in spectral sensitizing dye stain reduction.

TABLE IX

| Sample No. | Bleaching Composition/Additive | A* | Delta A* |
|---|---|---|---|
| 1 | Control - regular bleaching | 31.2848 | |
| 2 | Control - regular bleaching | 31.7802 | |
| 3 | 0.34 mmol Compound 1 | 29.4993 | −2.0 |
| 4 | 0.34 mmol Compound 1 | 28.8914 | −2.6 |
| 5 | 1.02 mmol Compound 1 | 28.4813 | −3.1 |
| 6 | 1.02 mmol Compound 1 | 27.5573 | −4.0 |
| 7 | 2.04 mmol Compound 1 | 27.0539 | −4.5 |
| 8 | 2.04 mmol Compound 1 | 27.5584 | −4.0 |

EXAMPLE 7

Color Negative Processing Using A Fixing Composition

An experiment was conducted like that described in Example 6 except that Compound 1 was added to the fixing composition solution (instead of to the bleaching composition) to provide a composition of this invention. The results are shown in TABLE X below.

TABLE X

| Sample No. | Fixing Composition/Additive | A* | Delta A* |
|---|---|---|---|
| 1 | Control - regular fixing | 31.6461 | |
| 2 | Control - regular fixing | 31.3141 | |
| 3 | 0.34 mmol Compound 1 | 28.8446 | −2.6 |
| 4 | 0.34 mmol Compound 1 | 29.1590 | −2.3 |
| 5 | 1.02 mmol Compound 1 | 25.1601 | −6.3 |
| 6 | 1.02 mmol Compound 1 | 26.9848 | −4.5 |
| 7 | 2.04 mmol Compound 1 | 25.1717 | −6.3 |
| 8 | 2.04 mmol Compound 1 | 26.1277 | −5.4 |

EXAMPLE 8

Color Paper Processing Using A Bleach-fixing Composition

Compound 1 was dissolved in samples of the standard Process RA-4 Bleach Fix composition (Eastman Kodak Company) to provide compositions of this invention. Film samples of commercially available KODAK EDGE 7 Color Paper and KODAK EP5 Color Paper were processed unexposed to obtain Dmin. They were processed using the conventional Process RA-4 photochemical compositions and steps (shown below) in a sinkline processor, but with a modified bleach-fixing composition containing Compound 1.

Commercial Process RA-4

| PROCESSING STEP | PROCESSING COMPOSITION | PROCESSING TIME | PROCESSING TEMPERATURE |
|---|---|---|---|
| Color development | KODAK EKTACOLOR RA Color Developer | 45 seconds | 38° C. |
| Bleach-fixing | KODAK EKTACOLOR RA Fixer & Replenisher | 45 seconds | 38° C. |
| Washing | Water | 90 seconds | 38° C. |

After processing, the reflection spectra of the films were recorded, and from these spectra the CIELAB parameters were calculated. The CIELAB results are listed in TABLE XI below. The parameter of interest is B* that represents the yellow-blue axis in color space. The more negative the value of B* the less yellow is the appearance of the paper, indicating removal of the yellow spectral sensitizing dye and less dye stain. From many replicates, the reproducibility of the B* measurement was found to be ±0.2. Therefore, any reduction in B* greater than 0.2 represents a significant improvement in spectral sensitizing dye stain reduction.

A reduction in the variability of the spectral sensitizing dye stain due to variations in wash time is also desirable. The standard deviation of the B* measurement over a standard series of wash times (from 15 to 600 seconds) following the bleach-fixing step in the process is another indicator of the effectiveness of Compound 1. A smaller standard deviation indicates a more effective spectral sensitizing dye stain reducing agent. For many replicates, the reproducibility of the standard deviation was found to be about ±0.1. Therefore, any reduction in B* standard deviation greater than 0.1 represents a significant improvement in spectral sensitizing dye stain reduction.

TABLE XI

| Color Paper Sample | Bleach-fixing Composition/ Additive | Average A* | Average B* | Std. Dev. A* | Std. Dev. B* |
|---|---|---|---|---|---|
| KODAK EDGE 7 | Control - regular bleach/fixing | −0.937 | −2.20 | 0.55 | 1.08 |
| KODAK EDGE 7 | 0.5 g/l of Compound 1 | −0.556 | −3.16 | 0.36 | 0.82 |
| KODAK EDGE 7 | 1.0 g/l of Compound 1 | −0.399 | −3.71 | 0.30 | 0.64 |
| KODAK EDGE 7 | 3.0 g/l of Compound 1 | −0.082 | −4.35 | 0.22 | 0.52 |
| KODAK EP5 | Control - regular bleach/fixing | −1.207 | −1.33 | 0.68 | 1.43 |
| KODAK EP5 | 0.5 g/l of Compound 1 | −0.730 | −2.64 | 0.48 | 1.13 |
| KODAK EP5 | 1.0 g/l of Compound 1 | −0.511 | −3.20 | 0.42 | 0.89 |
| KODAK EP5 | 3.0 g/l of Compound 1 | −0.139 | −3.90 | 0.30 | 0.79 |

EXAMPLE 9

Color Paper Processing Using a Color Developing Composition

An experiment was carried out like Example 8 except that Compound 1 was dissolved in the standard Process RA-4 Color Developer (Eastman Kodak Company) to provide a composition of this invention. Film samples of commercially available KODAK EDGE 7 Color Paper and KODAK EP5 Color Paper were processed unexposed to obtain $D_{min}$. They were processed using the Process RA-4 steps and photochemicals in a sinkline processor, but using a modified bleach-fixing composition containing Compound 1. After processing, the reflection spectra of the film samples were recorded, and from these spectra the CIELAB parameters were calculated. The CIELAB results are listed below in TABLE XII. As described in the preceding example, the parameter of interest is B* that represents the yellow-blue axis in color space. Therefore, any reduction in B* greater than 0.2 represents a significant improvement in spectral sensitizing dye stain reduction.

A reduction in the variability of the spectral sensitizing dye stain due to variations in wash time is also desirable. The standard deviation of the B* measurement over a standard series of wash times (from 15 to 600 seconds) following the bleach-fixing step in the process is another indicator of the effectiveness of the spectral sensitizing dye stain reducing agent (e.g. Compound 1). A smaller standard deviation indicates a more effective compound. For many replicates, the reproducibility of the standard deviation was found to be about ±0.1. Therefore, any reduction in B* standard deviation greater than 0.1 represents a significant improvement in spectral sensitizing dye stain reduction.

TABLE XII

| Color Paper Sample | Additive in Color Developing Composition | Additive amount (g/l) | Average A* | Average B* | Std. Dev. A* | Std. Dev. B* |
|---|---|---|---|---|---|---|
| KODAK EDGE 7 | None | 0 | −0.046 | −0.914 | 0.048 | 0.431 |
| KODAK EDGE 7 | PHORWITE REU (control) | 1.0 | −0.160 | −1.359 | 0.055 | 0.331 |
| KODAK EDGE 7 | Compound 1 (invention) | 1.0 | −0.083 | −1.221 | 0.036 | 0.305 |
| EP5 | None | 0 | −0.256 | 0.076 | 0.060 | 0.508 |
| EP5 | PHORWITE REU (control) | 1.0 | −0.401 | −0.551 | 0.082 | 0.412 |
| EP5 | Compound 1 (invention) | 1.0 | −0.283 | −0.462 | 0.062 | 0.358 |

The invention has been described in detail with particular reference to preferred embodiments thereof, but it will be understood that variations and modifications can be effected within the spirit and scope of the invention.

We claim:

1. A photographic dye stabilizing or final rinsing composition comprising at least 0.0001 mol/l of a photographic dye stabilizing agent, and at least $5\times10^{-5}$ mol/l of a spectral sensitizing dye stain reducing agent that is a colorless or slightly yellow compound having an extended planar π system, that is devoid of a diaminostilbene fragment or fused triazole nucleus, and that has a solubility of at least $5\times10^{-5}$ mol/l in wahter at room temperature.

2. The photographic dye stabilizing or final rinsing composition of claim 1 wherein said spectral sensitizing dye stain reducing agent is a 2,6-diarylaminotriazine.

3. The photographic dye stabilizing or final rinsing composition of claim 1 wherein said spectral sensitizing dye stain reducing agent is a 2,6-dinaphthylaminotriazine having at least two solubilizing groups attached to one or both naphthyl groups.

4. The photographic dye stabilizing or final rinsing composition of claim 3 wherein said spectral sensitizing dye stain reducing agent has at least two sulfo groups.

5. The photographic dye stabilizing or final rinsing composition of claim 1 wherein said spectral sensitizing dye stain reducing agent is represented by Structure I:

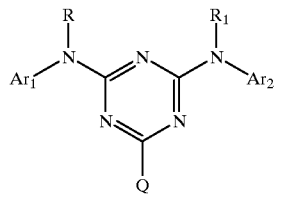

wherein $Ar_1$ and $Ar_2$ are independently carbocyclic or heterocyclic aromatic groups comprising at least 2 solubilizing groups on one or both aromatic groups, Q is hydrogen, hydroxy, thiol, carboxy, sulfo, a —$NR_2R_3$ group, a —$OR_2$ group or a halo group, R and $R_1$ are independently hydrogen, an alkyl group having 1 to 3 carbon atoms or a hydroxyalkyl group having 1 to 3 carbon atoms, and $R_2$ and $R_3$ are independently hydrogen, an alkyl group, or a phenyl group.

6. The photographic dye stabilizing or final rinsing composition of claim 5 wherein said solubilizing groups include one or more sulfo, carboxy, hydroxy, sulfonamido or carbonamido groups.

7. The photographic dye stabilizing or final rinsing composition of claim 5 wherein $Ar_1$ and $Ar_1$ are independently carbocyclic aromatic groups.

8. The photographic dye stabilizing or final rinsing composition of claim 5 wherein R and $R_1$ are independently hydrogen, methyl or hydroxymethyl.

9. The photographic dye stabilizing or final rinsing composition of claim 5 wherein $Ar_1$ and $Ar_2$ are each naphthyl, said solubilizing groups are sulfo, and Q is hydrogen, hydroxy, sulfo or a halo group.

10. The photographic dye stabilizing or final rinsing composition of claim 1 wherein said sensitizing dye stain reducing agent is Compound 1
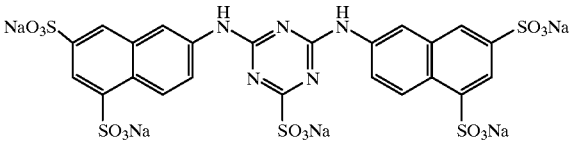
Compound 2
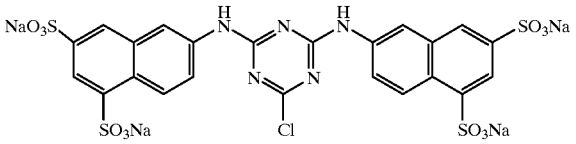
Compound 3
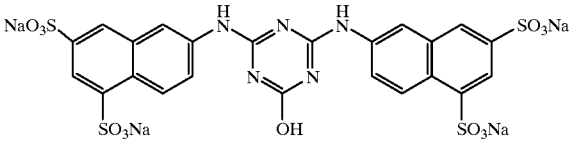
Compound 4
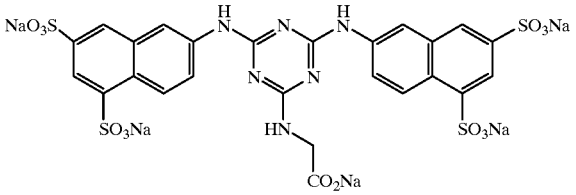
Compound 5
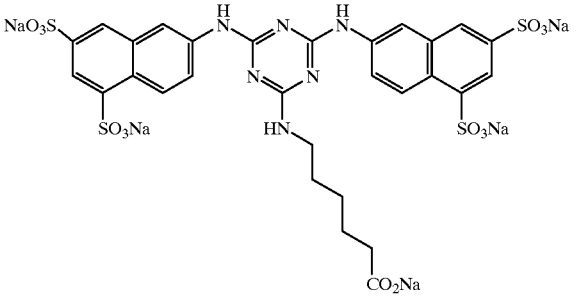
Compound 6
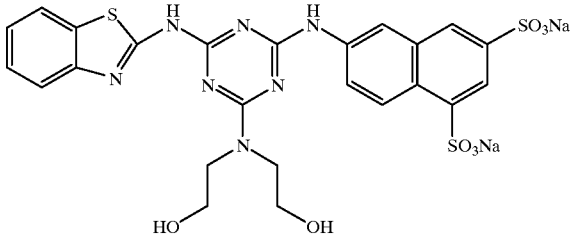
Compound 7
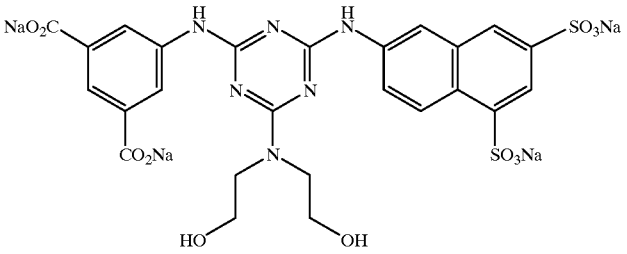
Compound 8
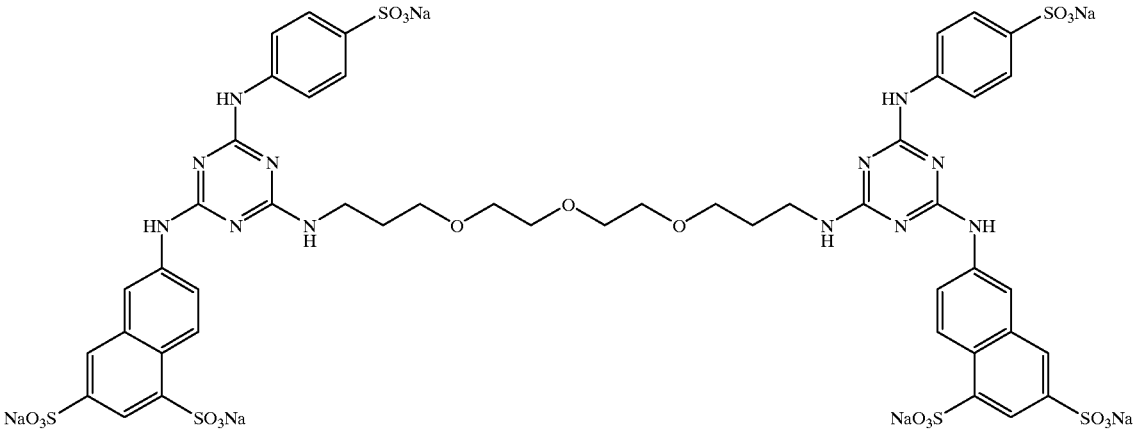

-continued
Compound 9
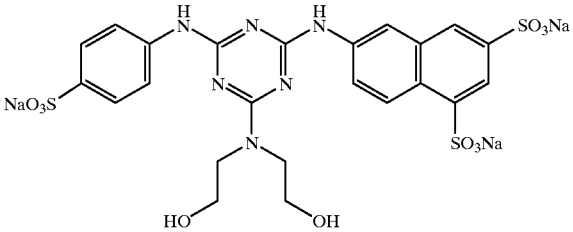
Compound 10
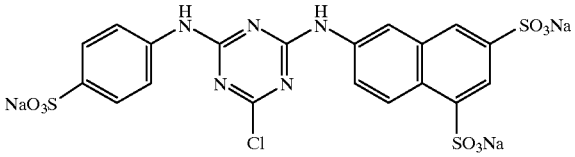
Compound 11
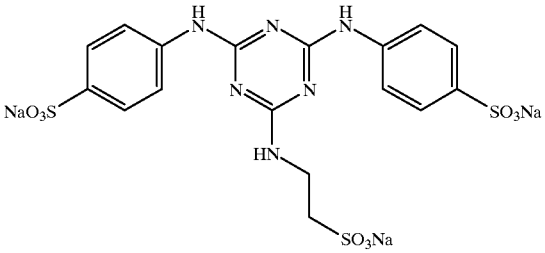
Compound 12
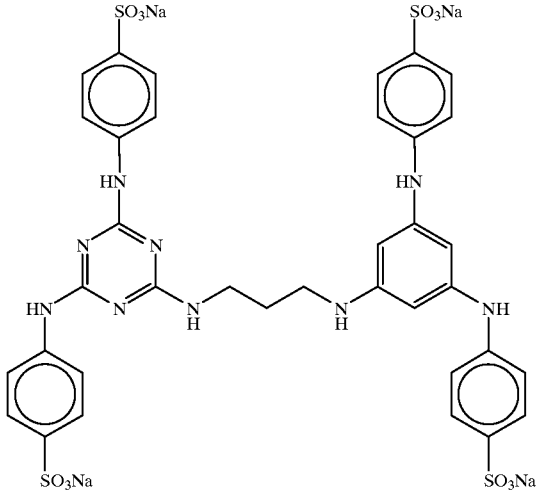
Compound 13
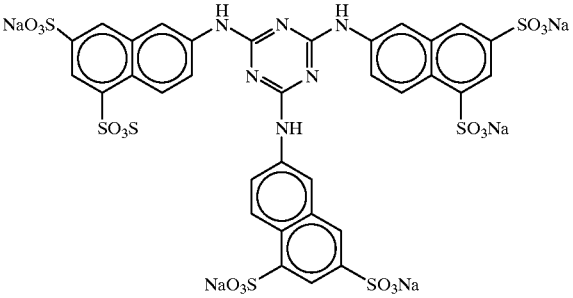
Compound 14
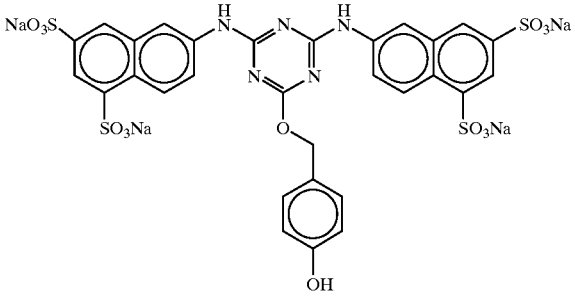
Compound 15
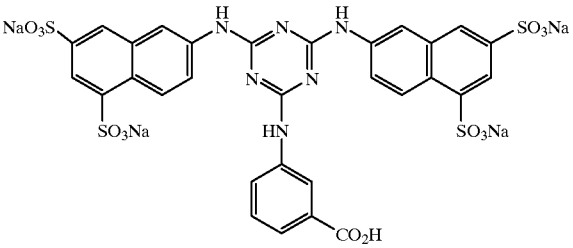
Compound 16
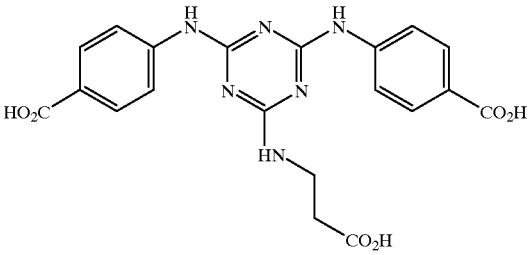
Compound 17
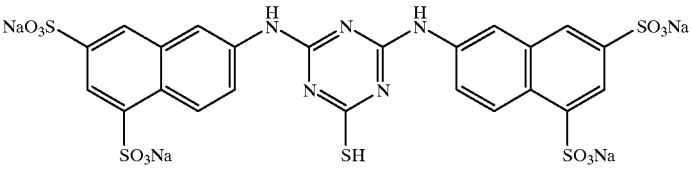

11. The photographic dye stabilizing or final rinsing composition of claim 1 wherein said spectral sensitizing dye stain reducing agent is present in an amount of from about $5\times10^{-5}$ to about 0.01 mol/l.

12. The photographic dye stabilizing or final rinsing composition of claim 1 wherein said photographic dye stabilizing agent is present in an amount of from about 0.0001 to about 0.01 mol/l.

13. The photographic dye stabilizing or final rinsing composition of claim 1 wherein said dye stabilizing agent is an alkali metal formaldehyde bisulfite; hexamethylenetetramine, or a benzaldehyde.

14. The photographic dye stabilizing or final rinsing composition of claim 13 wherein said dye stabilizing agent is sodium formaldehyde bisulfite.

15. The photographic dye stabilizing or final rinsing composition of claim 1 further comprising a bleach-accelerating compound.

16. The photographic dye stabilizing or final rinsing composition of claim 1 further comprising one or more anionic, nonionic, or amphoteric surfactants.

* * * * *